US009062459B2

(12) United States Patent
Berkowitz et al.

(10) Patent No.: US 9,062,459 B2
(45) Date of Patent: Jun. 23, 2015

(54) ROLL ROOFING

(75) Inventors: Barbara Berkowitz, Gilbertsville, PA (US); Gregory F. Jacobs, Oreland, PA (US); Brett Thibodeau, Wayne, PA (US); Husnu M. Kalkanoglu, Swarthmore, PA (US)

(73) Assignee: CertainTeed Corporation, Valley Forge, PA (US)

( * ) Notice: Subject to any disclaimer, the term of this patent is extended or adjusted under 35 U.S.C. 154(b) by 14 days.

(21) Appl. No.: 12/627,235

(22) Filed: Nov. 30, 2009

(65) Prior Publication Data

US 2010/0071291 A1 Mar. 25, 2010

Related U.S. Application Data

(63) Continuation of application No. 11/383,769, filed on May 17, 2006, now abandoned.

(51) Int. Cl.
*B65H 16/06* (2006.01)
*E04D 15/06* (2006.01)

(52) U.S. Cl.
CPC ..... *E04D 15/06* (2013.01)

(58) Field of Classification Search
USPC ..... 242/588, 588.1, 588.2, 588.3, 588.5, 242/600, 601, 614, 614.1, 590; 206/410, 206/413, 428
See application file for complete search history.

(56) References Cited

U.S. PATENT DOCUMENTS

| | | | | |
|---|---|---|---|---|
| 2,501,201 | A | | 3/1950 | Wilcox |
| 3,559,914 | A | * | 2/1971 | Alderman ..... 242/598 |
| 3,858,723 | A | | 1/1975 | Weiss |
| 4,099,682 | A | * | 7/1978 | Benuska ..... 242/533.7 |
| 4,222,212 | A | * | 9/1980 | Alderman ..... 242/598.5 |
| 4,226,380 | A | | 10/1980 | Gay |
| 4,444,313 | A | | 4/1984 | Tyson |
| 5,452,797 | A | | 9/1995 | Pollard |
| 5,484,082 | A | | 1/1996 | Casper et al. |
| 6,138,941 | A | | 10/2000 | Miyake |
| 6,409,017 | B1 | | 6/2002 | Bookbinder et al. |
| 6,612,473 | B1 | | 9/2003 | Newby et al. |
| 7,132,143 | B2 | | 11/2006 | Zanchetta et al. |
| 7,270,293 | B1 | | 9/2007 | Karoly |
| 7,341,220 | B2 | | 3/2008 | Katayama |
| 2006/0243388 | A1 | | 11/2006 | Kubiak et al. |

* cited by examiner

*Primary Examiner* — William A Rivera
(74) *Attorney, Agent, or Firm* — Paul & Paul

(57) ABSTRACT

A roll roofing material is provided in the form of a cylindrical roll that may or may not have an exterior covering thereon, and with transverse members being provided, carried by the cylindrical roll, and which protrude generally outwardly of an exterior cylindrical surface of the roll. The transverse members inhibit rolling of the roll roofing either off a pitched roof. One or more inserts may be provided in a hollow core of the roll, and connectors may attach a strap to these inserts for transporting the same from ground to a rooftop, or otherwise. Protective covers may be provided at opposite ends of the roll roofing, and the protective covers may comprise the transverse members, as may be desired.

16 Claims, 5 Drawing Sheets

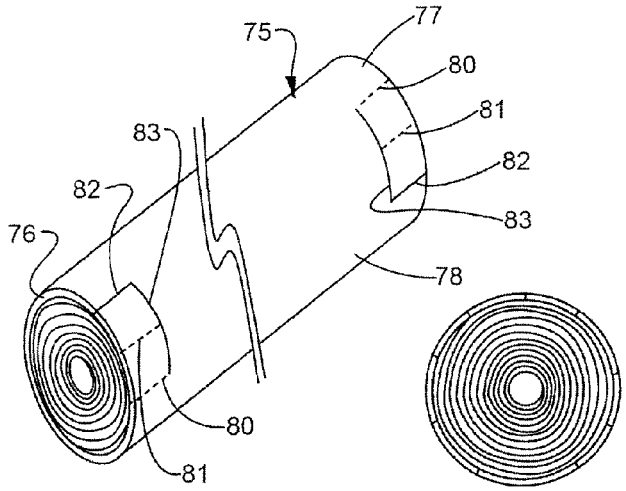
Fig. 7
Fig. 8
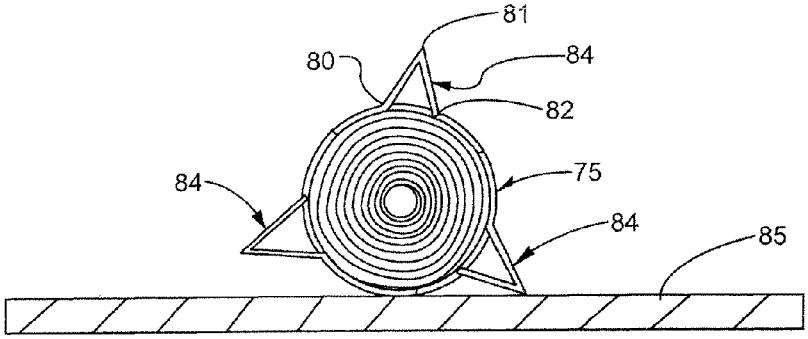
Fig. 9

ROLL ROOFING

CROSS-REFERENCE TO RELATED APPLICATION

This is a continuation of U.S. application Ser. No. 11/383,769 filed May 17, 2006, the complete disclosure of which is herein incorporated by reference.

BACKGROUND OF THE INVENTION

It is known in the roofing art to provide roll roofing material, formed into cylindrical rolls. Such roll roofing material will generally comprise asphalt saturated felts, which may function as starter strips on a roof, or as underlayments on a roof over which shingles may be applied. Generally, when used as starter strips, or as underlayments, the roll roofing material, with or without mineral surfaces applied on the outwardly-facing surface, will be applied on sloped roofs. Sometimes granules or other minerals are applied in an embedded form to the outwardly-facing surface of the roll roofing material during its manufacture.

Typically, rolled roofing is sold in boxes. However, the boxing-up of roll roofing can be resource-intensive during production, requiring additional labor to box the material and to then palletize the boxes. Such packaging, when it is done, can cause a reduction in the speed of production lines.

Additionally, boxes can offer protection from ultraviolet light, and it is desirable to avoid placing roofing products where they can be subjected to unnecessary ultraviolet light, in order to avoid degradation of the roofing materials. For example, some adhesives, such as can be used on self-adhering membranes (roll roofing type) can be susceptible to ultraviolet degradation. Other adhesives can also be susceptible to ultraviolet degradation. Sometimes roll roofing material is placed in an opaque liner that covers the outside of the rolled roofing products, but often, even when the outside or cylindrical surface of the roll roofing material is wrapped with an opaque liner, the ends of the rolls can be exposed to ultraviolet light, thereby leading to adhesive degradation and loss of adhesive tack at the outermost edges of the roll roofing product.

Furthermore, when roll roofing materials are applied on a sloped or pitched roof, the roofing may roll off the roof, creating a hazardous working environment. Sometimes, the roll roofing is placed in boxes to stabilize them and prevent them from rolling off the roof.

Additionally, due to the size and shape of roll roofing, such roofing can be unwieldy and difficult to transport from the ground to the rooftop at a construction site. For example, typical sizes of roll roofing can be 36 inches wide and, when unrolled from their cylindrical form to a flat form, can be 36 feet long, 72 feet long, 144 feet long, etc., which, considering the materials from which roll roofing are created, including generally asphalt-impregnated webs, with particulate material applied thereto, such as granules, talc, etc., the weight involved in having to transport roll roofing from typically a ground level to a roofing level, up a ladder or the like, can create difficult labor situations.

SUMMARY OF THE INVENTION

In accordance with this invention, roll roofing is provided with end or other treatment that addresses the problem of stabilizing rolls on a roof, addresses the problem of photodegradation of adhesive at ends of the rolls, and which eases the transportability of rolls from ground level to rooftop.

Accordingly, it is a primary object of this invention to provide a novel roll roofing material of cylindrical configuration, in which a transverse member is provided, with portions protruding outwardly of the cylindrical surface of the roll roofing, such that when the roll roofing material is disposed on a roof, the transverse member will resist rolling of the roofing material off the roof.

It is a further object of this invention to accomplish the above object, wherein the roll roofing has a hollow core, with at least one insert disposed therein carrying the transverse member.

It is a further object of this invention to provide a protective cover for one or more ends of the roll of roofing material, and most preferably, with a protective cover providing a shield that inhibits photodegradation of any adhesive at the end of the roll roofing material.

It is another object of this invention to provide various configurations for the transverse member described above.

It is yet another object of this invention to provide connectors at opposite ends of the roll roofing material, with a carrying strap connected thereto, to facilitate transporting the roll of roofing material.

It is a further object of this invention, to provide a band disposed about the roll roofing, with the band being openable for movement from a cylindrical configuration to a more flattened configuration, to prevent rolling of the roll roofing material off a sloped roof.

Other objects and advantages of the present invention will be readily apparent upon a reading of the following brief descriptions of the drawing figures, the detailed descriptions of the preferred embodiments, and the appended claims.

BRIEF DESCRIPTIONS OF THE DRAWING FIGURES

FIG. 7 is yet another alternative embodiment of a roll roofing material, with anti-roll end treatments.

FIG. 8 is an end view of the roll roofing material illustrated in FIG. 7.

FIG. 9 is an illustration of the roll roofing material of FIG. 7, shown disposed on a roof, which, in turn, is shown in section, and wherein portions of an exterior covering for the cylindrical roll roofing material of FIG. 7 are shown in protruding format, functioning as transverse anti-rolling members.

DETAILED DESCRIPTIONS OF THE PREFERRED EMBODIMENTS

Figure 1:
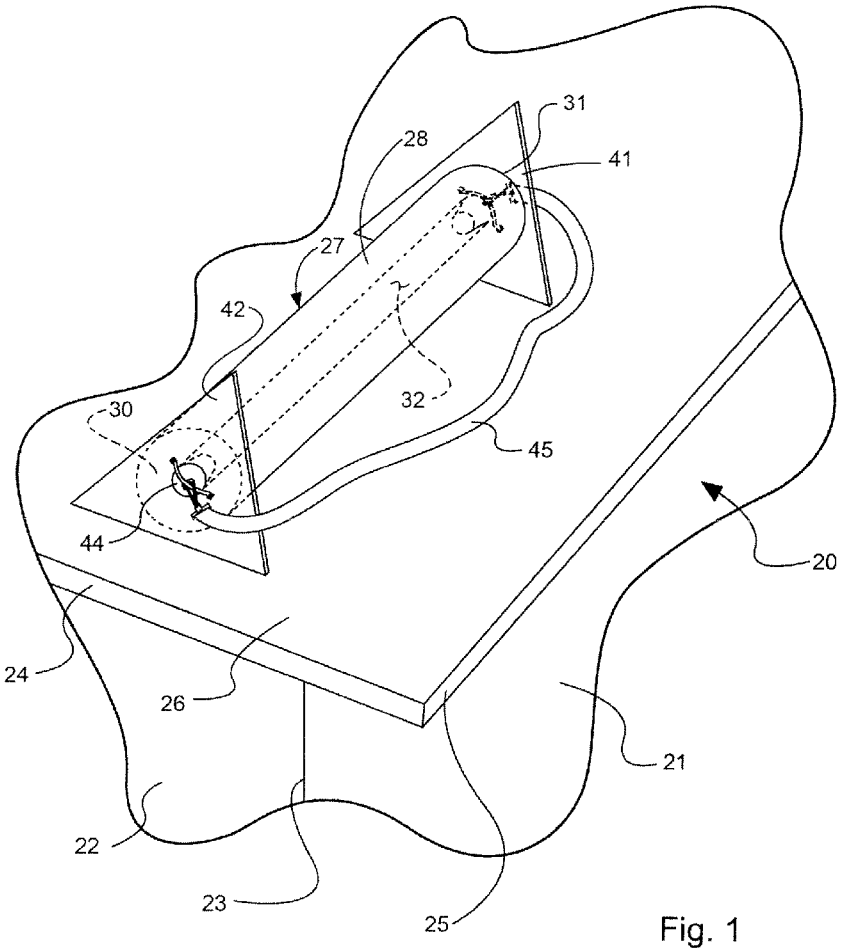
FIG. 1 is a fragmentary top view of a roll roofing material with a specialized end treatment, shown disposed on a sloped or pitched roof, with transverse members at the ends of the roofing material preventing the rolling of the rolled roofing material off the roof, and with a carrying strap attached at ends of the rolled roofing material, for facilitating transport of the same.

Referring now to the drawings in detail, reference is first made to FIG. 1, wherein there is fragmentally illustrated a building generally designated by the numeral 20, having adjacent walls 21 and 22, that meet at a corner 23, and wherein a roof 24, of the sloped or pitched type is illustrated, having an overhang 25, and with the upper surface 26 of the roof being sloped, as shown.

A roll roofing material generally designated 27 is shown disposed on the roof. The roll roofing material 27 includes a wound cylindrical roll 28 which, between its ends 30, 31 may, for example, be 36 inches in length, and which may, in an unrolled (not shown) condition be anywhere from 36 feet to 144 feet or more, in length. The roll roofing material 27 will generally have a cylindrical hollow core 32, which may be comprised of a hollow cardboard, plastic or the like sleeve, about which the roll roofing material is wound.

Figure 2:
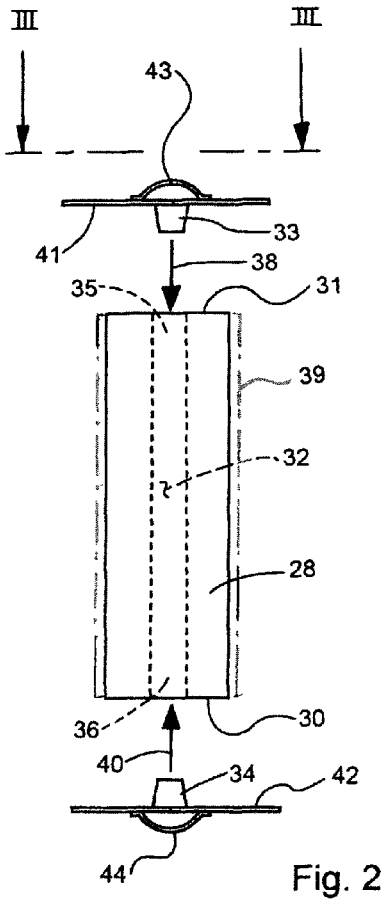
FIG. 2 is an exploded view of the roll roofing material with specialized end treatment illustrated in FIG. 1, with the end treatments thereof shown in exploded form, prior to application of the end treatments to the ends of the roll of roofing material.
Figure 3:
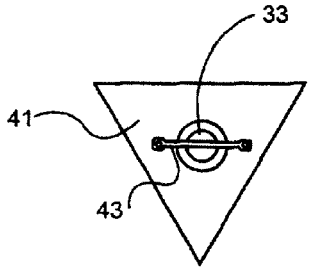
FIG. 3 is a plan view of one of the end treatments illustrated in FIG. 2, taken generally along the line III-III of FIG. 2.

With specific reference to FIGS. 2 and 3, the roll roofing material 28 may have tapered or otherwise configured plug-like inserts 33, 34 placed into the open ends 35, 36, respectively, by moving them in the directions of the arrows 38, 40, as shown. The inserts 33, 34 carry triangular end plates 41, 42, as shown, which extend generally transversely of the longitudinal axis of the hollow cylindrical core 32, and which have a greater transverse dimension than the diameter of the outer cylindrical surface of the roll material 28, as shown in FIG. 2. A protective wrapping or cover 39 (shown in phantom) may be provided for the roll roofing material.

The transverse triangular end plates 41, 42 provide protective covers for adhesive or other materials that would otherwise be exposed at the ends 30, 31 of the roll roofing material 28, to inhibit photodegradation of adhesives or the like at the ends of the roll roofing material 28.

The transverse end plates 41, 42 are also provided with connectors 43, 44, preferably of the handle type, at opposite ends, such that when the insert members 33, 34 are inserted into the respective ends 35, 36 of the roll roofing material 28, a carrying strap 45 may be connected thereto, for ease of transporting the roll roofing material from the ground to a roof, such as by means of a roofer placing the same over a shoulder and carrying the same up a ladder for disposition of the roll roofing material on a roof 24, as shown. The carrying strap 45 is equipped with attachment means, which optionally may be of a quick attachment or release type, such as, for example, carabiner clips, spring closed hooks, swivel hooks, snap hooks, a loop with a snap, or the like. Thus, it will be seen that the roll roofing material as shown in FIG. 1 is not likely to roll off the roof 24, regardless of the slope or pitch of the roof.

Figure 4:
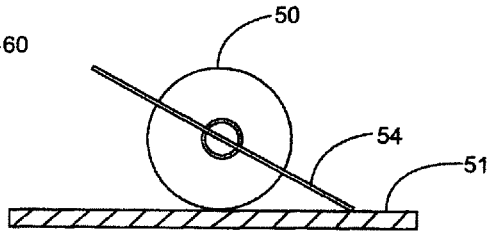
FIG. 4 is a sectional view, through another portion of a roof, wherein a different embodiment of end treatment for a roll roofing material is shown, having a transverse member preventing rolling of the same relative to the roof.

With reference now to FIG. 4, an alternative roofing material 50 is shown, disposed on a generally flat roof 51. The roll roofing material 50 is likewise cylindrically wound, and may or may not have a paper, plastic or other wrapping on the exterior surface 49 thereof, as may the roll roofing material 28 likewise have, if desired, with the roll roofing material 50 likewise have a cardboard, plastic or like cylindrical core 56 disposed therein. End inserts 52, generally frusto-conically configured as shown at 52 may be provided in one or both ends 53 of the roll roofing material 50. The inserts 52 may have some means for accommodating a transverse bar 54 therein, such as the vertical slot 55 shown in FIG. 5. The transverse bar will be of a transverse dimension that is greater than the diametral dimension of the exterior of the cylindrical roll 50, to inhibit the rolling of the same along the roof 51. Protective end covers (not shown) may optionally be provided for the roll roofing material 50 shown in FIG. 5, similar to the protective covers illustrated in the embodiment of FIG. 2. When other anti-rolling structures like the bar 54 are used, the anti-rolling triangular covers can take on other configurations than triangular, or can be eliminated altogether if desired.

Figure 6:
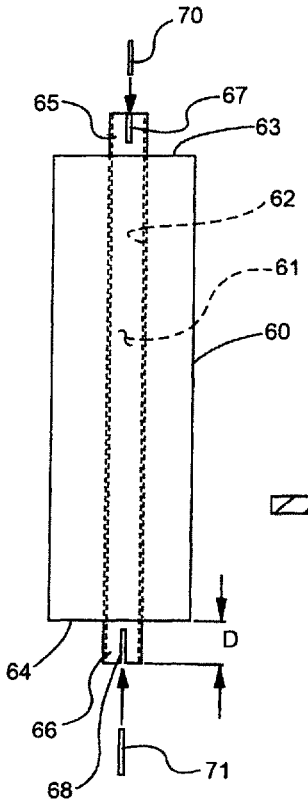
FIG. 6 is an alternative embodiment of a roll roofing material, with a different arrangement for end treatment, to prevent rolling of the roll roofing material off a roof.

With reference now to FIG. 6, another embodiment of roll roofing material 60 is illustrated, also with a hollow cylindrical core 61, in which is disposed a hollow cardboard, plastic or the like sleeve 62, but in the embodiment of FIG. 6, the sleeve 62 extends outwardly of the ends 63, 64 of the roll roofing material 60, an amount "D", resulting in endwise projections 65, 66, as shown.

Figure 5:
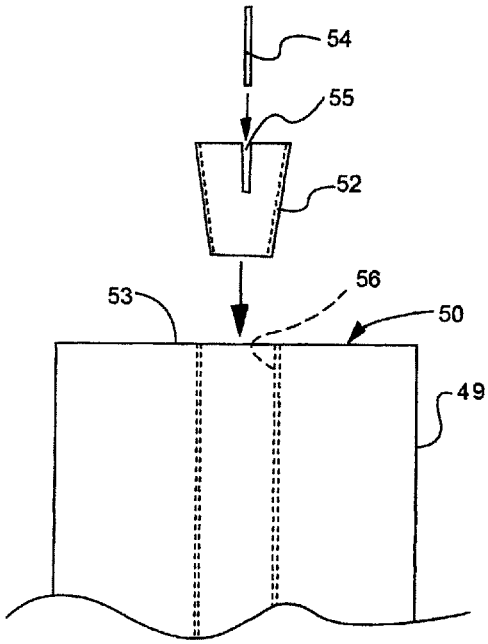
FIG. 5 is an exploded view of a portion of roll roofing material of hollow core, with an end insert and transverse member in exploded form, adapted to be applied to an end of the roll roofing material.

The projecting ends 65, 66 may have slots 67, 68, respectively, for receipt therein of bars 70, 71, likewise having dimensions in the transverse direction (not shown) like those of the bars 54 for the embodiments of FIGS. 4 and 5, to prevent rolling of the roll roofing material relative to a pitched roof.

With reference now to FIG. 7, a roll of roll roofing material 75 is illustrated, having opposite ends 76, 77, with an exterior paper, plastic or like covering 78 on the outer cylindrical surface thereof, and with the covering 78 having score lines 80, 81 and cut lines 82, 83 therein at preferably each end, such that anti-rolling projections 84 may be folded outwardly from the surface covering 78, in a transverse manner, as shown, to prevent rolling of the roll roofing material 75 relative to a pitched roof 85. The material making up the covering 78 is selected such that it has a degree of rigidity sufficient for the anti rolling projections 84 to inhibit rolling along the roof when deployed. It will be noted that in the embodiment shown, there are three different projections 84 around the periphery of the cylindrical covering 78 for the roll roofing material 75 at each end, generally equidistantly spaced from each other, approximately 120° each. It will also be noted that while three projections are depicted in FIG. 7, other quantities of projections could be provided so as to inhibit rolling along the roof.

With reference now to FIGS. 10-15, yet another embodiment of this invention is illustrated, in the form of a roll roofing material generally designated at 90, as comprising a roll of roofing material with an exterior protective wrapping 91 of paper, plastic, or other suitable type.

Figure 10:
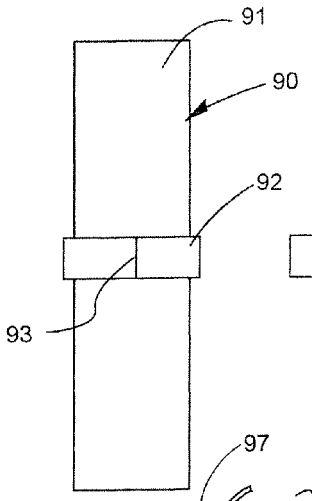
FIG. 10 is a top view of yet another alternative embodiment of anti-roll treatment for roll roofing material.
Figure 11:
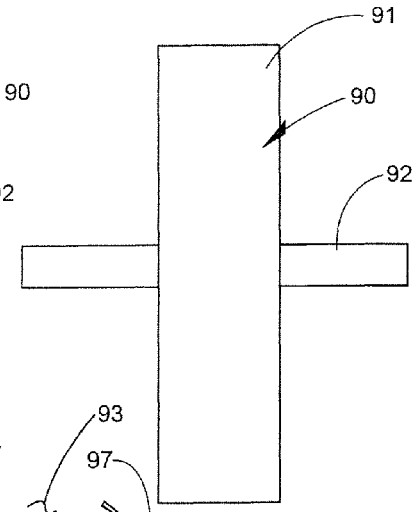
FIG. 11 is a view similar to that of FIG. 10, but wherein an anti-roll band, shown tightly disposed about the exterior cylindrical surface of the roll roofing material of FIG. 10, is shown in FIG. 11 in expanded anti-roll format.

A band 92, which may be of a plastic material or the like, or possibly metal as an alternative, is provided, disposed around the periphery of the wrapping 91 of the cylindrical roll material 90, with the band having an opening 93 therein, predisposed to be moved from a partial opening to a full opening, as by means of cutting along a score line or the like. The band 93 is thus moveable from its cylindrical configuration shown in FIG. 10, to a generally flattened configuration therefor shown in FIG. 11, in that the band 93 will preferably have a memory of the flattened condition therefor as shown in FIG. 11, after it is opened from its circular configuration as shown in FIG. 10. The wrapping 91 may extend the length of the roll of the roll roofing material as shown in FIG. 11. Optionally (not shown), the wrapping may simply be of sufficient dimension to serve the purpose of affixing the band 92 to the cylindrical roll material 90.

Figure 13:
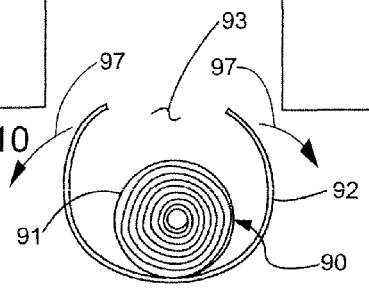
FIG. 13 is an end view of the roll roofing material of FIG. 10, but shown with the band partially open.
Figure 12:
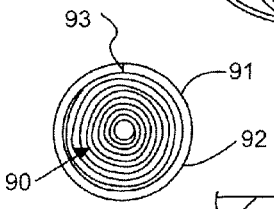
FIG. 12 is an end view of the roll roofing material shown in FIG. 10.

With reference to FIG. 12, it will be seen how the roll roofing material appears in end view. Referring now to FIG. 13, it will be seen that the band 92 is partially open and is in a state of returning to its remembered flat condition shown in FIG. 11, as it springs outwardly from its position illustrated in FIG. 12, to that illustrated in FIG. 11, as shown by the arrows 97 in FIG. 13.

Figure 14:
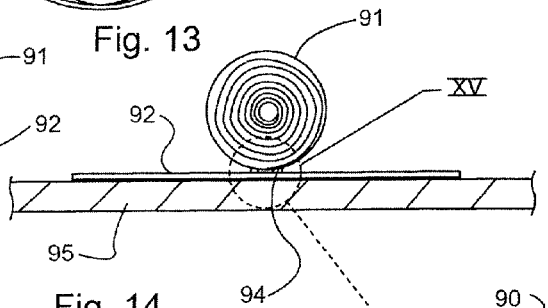
FIG. 14 is an end view of the roll roofing material and band of FIG. 13, but with the band fully opened and disposed on a roof, with the roof being shown fragmentally, and in section.
Figure 15:
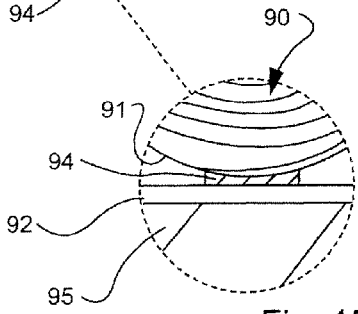
FIG. 15 is an enlarged detail view of a portion of the illustration of FIG. 14, taken from zone XV of FIG. 14, and wherein the connection between the open band and the outer surface of the roll roofing material is shown.

With reference to FIG. 14, the band 92 is shown adhesively connected at 94 to the exterior wrapping 91 included as part of the roll roofing material 90, with the fastening means 94 attaching the wrapping 91 to the band 92. The fastening means 94 can be an adhesive, a mechanical fastener, or other fastening means. Also, as shown in FIGS. 14 and 15, the band 92 lays on a roof 95, shown in section, and the roof 95 may be pitched as may be desired.

It will be apparent from the foregoing that various modifications may be made in the details of construction, as well as in the use and operation of the various features of this invention, all as defined in the appended claims.

What is claimed is:

1. A roll of roofing material with an anti-roll device for preventing rolling of the roll of roofing material off a roof when the roll of roofing material is disposed in a cylindrical roll on and against the surface of a sloped roof, comprising:

(a) a generally cylindrical roll comprising a roll of roofing material including an asphalt-impregnated web with particulate material in the form of granules applied thereto; with the roll of roofing material having a substantially hollow core portion at at least one end, and with the generally cylindrical roll having an outer cylindrical surface of a given diametric dimension;

(b) the anti-roll device having the following features:

(i) the anti-roll device is a means whereby, when the generally cylindrical roll is disposed on a sloped roof with its outer cylindrical surface against the surface of the sloped roof, the anti-roll device will resist rolling of the cylindrical roll off the roof; and (ii) the said means further comprises a transverse member of a transverse dimension greater than the given diametrical dimension of the cylindrical roll, whereby the transverse member protrudes generally outwardly of the cylindrical surface of the roll.

2. The roll of rooting material of claim 1. wherein at least one insert member is disposed in said hollow core portion at an end of the roll, carrying said transverse member.

3. The roll of roofing material of claim 2, with a protective cover as part of said generally cylindrical roll.

4. The roll of roofing material of claim 3, wherein the protective cover comprises inhibiting means inhibiting photodegradation of an adhesive at at least one end of the roll of roofing material.

5. The roll of roofing material of claim 2, wherein there are said hollow core portions, said transverse members and said insert members at both ends of said roll of roofing material.

6. The roll of rooting material of claim 5, wherein strap connector means is provided, carried on transverse members at opposite ends of said roll of roofing material, and with a carrying strap connected to said connector means at each end of said roll of roofing material, to facilitate transporting said roll of rooting material.

7. The roll of roofing material of claim 5, including strap connector means carried at opposite ends of said roll of roofing material, and with a carrying strap connected to said strap connector means at each end of said roll of roofing material, to facilitate transporting said roll of roofing material.

8. The roll of rooting material of claim 7, including an attaching means selected from the group consisting of a carabiner clip, a spring closed hook, a swivel hook, a strap hook, a loop with a snap and combinations thereof.

9. The roll of roofing material of claim 2, wherein the insert member(s) comprise(s) at least one plug disposed in said substantially hollow core portion(s) at said end(s) of said roll of roofing material.

10. The roll of roofing material of claim 1, wherein said transverse member is at at least one end of the cylindrical roll of roofing material.

11. The roll of roofing material of claim 1, wherein the transverse member comprises a triangular configuration.

12. The roll of roofing material of claim 1, wherein the generally cylindrical roll includes a generally cylindrical wrapping of protective layer.

13. The roll of roofing material of claim 12, wherein said transverse member(s) comprise(s) at least one outwardly foldable portion of said cylindrical wrapping, forming at least one outward projection extending beyond the cylindrical surface of said roll of roofing material.

14. The roll of rooting material of claim 1, wherein the transverse member comprises a bar.

15. The roll of roofing material of claim 1, wherein a generally cylindrical hollow sleeve is carried in said hollow core portion(s) and projects out of at least one end of said roll of rooting material: with means mounting said transverse member(s) on said hollow sleeve at at least one end of said roll of roofing material.

16. The roll of rooting material of claim 1, wherein said transverse member comprises a band disposed in a first condition about the periphery of said roll of roofing material and adhered thereto at a location inside the band, with means associated with the band for opening the same to move from a first condition to a second condition as a said transverse member.

* * * * *